US005505797A

United States Patent [19]

Yokota et al.

[11] Patent Number: 5,505,797

[45] Date of Patent: Apr. 9, 1996

[54] METHOD OF PRODUCING FERRITIC STAINLESS STEEL STRIP WITH SMALL INTRA-FACE ANISOTROPY

[75] Inventors: Takeshi Yokota; Susumu Satoh; Takumi Ujiro; Fusao Togashi; Makoto Kobayashi; Shohei Kanari, all of Chiba, Japan

[73] Assignee: Kawasaki Steel Corporation, Japan

[21] Appl. No.: 411,293

[22] Filed: Mar. 27, 1995

[30] Foreign Application Priority Data

Mar. 29, 1994 [JP] Japan ..... 6-058583

[51] Int. Cl.[6] ..... C21D 8/02

[52] U.S. Cl. ..... 148/610

[58] Field of Search ..... 148/610

[56] References Cited

FOREIGN PATENT DOCUMENTS

| | | | |
|---|---|---|---|
| 0045958 | 2/1982 | European Pat. Off. . | |
| 2651243 | 3/1991 | France . | |
| 52-039559 | 3/1977 | Japan . | |
| 53-048018 | 5/1978 | Japan . | |
| 54-056017 | 5/1979 | Japan . | |
| 134128 | 10/1980 | Japan | 148/610 |
| 62-010217 | 1/1987 | Japan . | |
| 62-294135 | 12/1987 | Japan . | |
| 01136930 | 5/1989 | Japan . | |
| 02007391 | 2/1990 | Japan . | |
| 04279202 | 10/1992 | Japan . | |
| 405112826 | 5/1993 | Japan | 148/610 |
| 05179358 | 7/1993 | Japan . | |
| 406081036 | 3/1994 | Japan | 148/610 |
| 1209345 | 10/1970 | United Kingdom | 148/610 |

*Primary Examiner*—Deborah Yee
*Attorney, Agent, or Firm*—Austin R. Miller

[57] ABSTRACT

A method of producing a ferritic stainless steel strip having reduced intra-face anisotropy as well as excellent r value and anti-ridging characteristics. The method involves subjecting a ferritic stainless steel slab to a hot rolling step including rough rolling having at least one rough rolling pass and a finish rolling having at least one finish rolling pass, followed by a hot-rolled sheet annealing, pickling, cold rolling and finish annealing. At least one of the passes in the rough rolling is conducted with the rolling temperature between about 970° C. to about 1150° C., the friction coefficient between the rolls and the rolled material of about 0.3 or less, and the rolling reduction ratio between about 40 to about 75%.

5 Claims, 1 Drawing Sheet

FIGURE
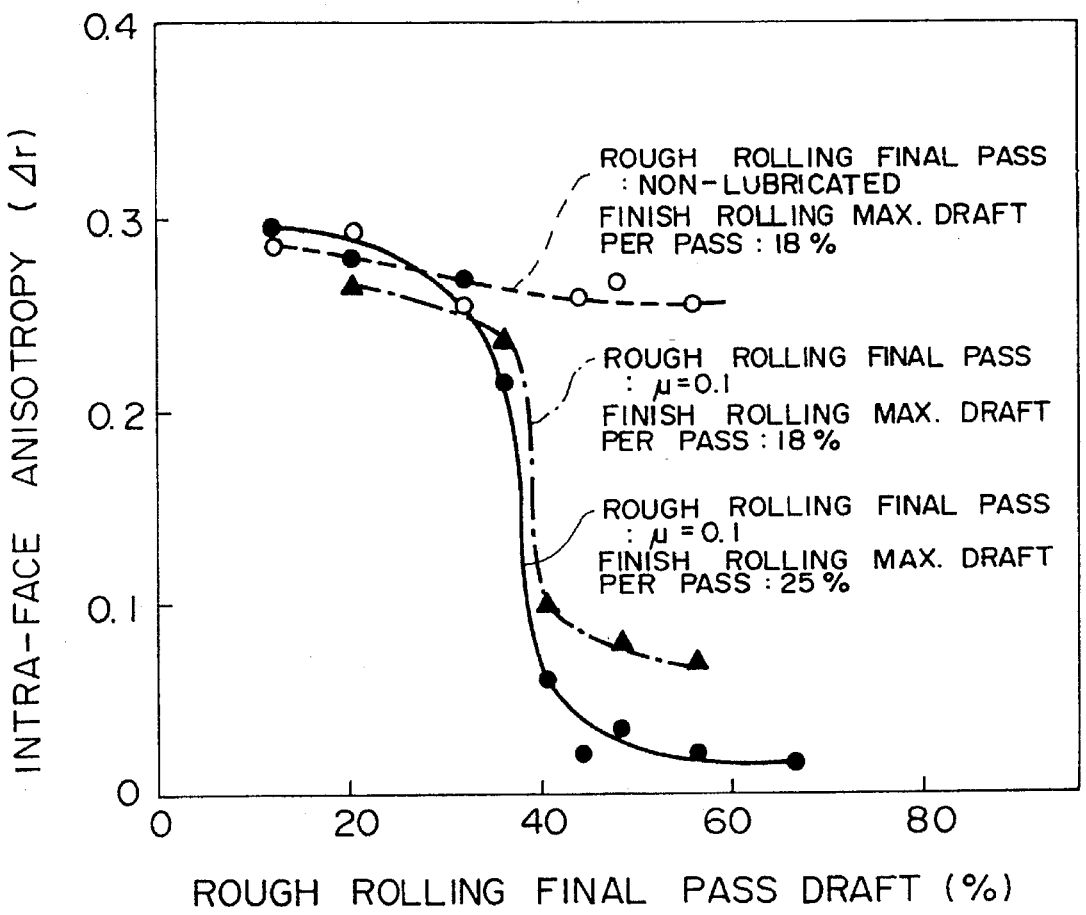

METHOD OF PRODUCING FERRITIC STAINLESS STEEL STRIP WITH SMALL INTRA-FACE ANISOTROPY

BACKGROUND OF THE INVENTION

1. Field of the Invention

The present invention relates to a method of producing a ferritic stainless steel strip which has a small intra-face anisotropy and which excels both in Lankford value (r value) and anti-ridging characteristics.

2. Description of the Related Art

In general, a ferritic stainless steel product is produced by heating a continuously-cast slab and subjecting the heated continuously-cast slab to a series of treatments including hot rolling (rough hot rolling and finish hot rolling), annealing, cold rolling and finish annealing.

Ferritic stainless steel thus produced is generally inexpensive and excellent in resistance to stress corrosion cracking and, hence, is widely used as material in fields such as cooking utensils and automotive parts, for example. This type of steel, however, is inferior to austenitic stainless steel in regard to press formability in terms of r value and anti-ridging characteristic. In addition to the r value and anti-ridging characteristics, intra-face anisotropy of the r value (referred to also as "Δr" or merely as "intra-face anisotropy") is another important factor which rules quality of press forming, since heavy earing occurs in the press product when the Δr is large.

Thus, if both press formability and intra-face anisotropy of ferritic stainless steel could be remarkably improved, such ferritic stainless steel could be substituted for austenitic stainless steel because it could sustain severe conditions of press forming which hitherto could not be withstood by ferritic stainless steel.

Unfortunately, no presently known method simultaneously improves all of these three factors, i.e., r value, anti-ridging characteristic and intra-face anisotropy, of various compositions of ferritic stainless steel.

A method has been disclosed in Japanese Patent Laid-Open No. 53-48018 and Japanese Patent Publication No. 2-7391, in which Nb and Ti are added to steels having very small C and N contents (super-low C,N steel) to improve the r value and the anti-ridging characteristics of the steel.

Meanwhile, Japanese Patent Laid-Open No. 5-179358 discloses a method in which anti-ridging characteristics are improved by hot rolling with a large draft (rolling reduction), while Japanese Patent Laid-Open No. 3-219013 discloses a method in which hot rolling with a large reduction ratio is employed to improve the r value. These methods featuring merely a large reduction ratio during hot rolling disadvantageously impair the surface of the steel sheet by creating hot-roll flaws attributable to seizure between the steel sheet and roll due to the large shearing stress that is created in the surface region of the steel strip because of the large reduction ratio.

Japanese Patent Laid-Open No. 62-10217 discloses a method in which the value of the ratio (strain rate)/(friction coefficient) is controlled to 500 or greater so as to improve anti-ridging characteristics during press forming. This method, however, fails to improve intra-face anisotropy although it can appreciably improve the anti-ridging characteristic. Furthermore, this method essentially applies a large strain rate at the low temperature region of 780° to 940° C., thus creating problems such as failure to catch slabs in the roll nip or inferior sheet profiles.

Thus, known methods can improve either r value or anti-ridging characteristics but cannot simultaneously improve all three factors: namely, r value, anti-ridging characteristic and intra-face anisotropy. Moreover, these known methods or proposals tend to create problems such as impairment of the surface nature, sheet catching failure and inferior sheet profile.

Japanese Patent Laid-Open No. 52-39599 teaches a method for reducing intra-face anisotropy. The improvement in intra-face anisotropy can only be achieved by strictly controlling the ratio of draft between primary cold rolling and secondary cold rolling. In particular, small values of intra-face anisotropy (Δr) such as 0.11 and 0.13 for low-C, -N steel containing Ti can be obtained only by conducting primary cold rolling at the severely high reduction ratio of 87% (reduction ratio of secondary cold rolling is 0%). Other steel compositions and other rolling conditions cannot provide intra-face anisotropy below 0.45. Furthermore, an 87% cold rolling reduction ratio is extremely high when compared with ordinary cold rolling processes and, hence, is very difficult to effect. In addition, such an extremely large reduction ratio tends to reduce dimensional precision and degrade steel sheet profile. This published specification also fails to mention anti-ridging characteristics at all. Considering that ridging is caused by a {001} hot-rolling aggregate structure generated in the core of the sheet, it is very difficult to appreciably improve the anti-ridging characteristic of the steel because the {001} hot-rolling aggregate structure will not be broken even under a severe cold-rolling reduction ratio of 87%.

Japanese Patent Laid-Open No. 54-56017 discloses that intra-face anisotropy of Al-rich ferritic stainless steel can be reduced to small values such as 0.14 or 0.21 by controlling the N content to range between 0.025% and 0.12% and by meeting the condition of $0.015<N-(14/27)\,Al<0.55\%$.

Thus, improving intra-face anisotropy according to known methods requires strict compositional control or severely high cold rolling reductions. Moreover, these known methods improve intra-face anisotropy without making a simultaneous improvement in r value of the steel or its anti-ridging characteristics.

SUMMARY OF THE INVENTION

Accordingly, an object of the invention is to provide a method for producing ferritic stainless steel strip which exhibits small intra-face anisotropy and which excels both in r value and anti-ridging characteristic as compared with ferritic stainless steel strips produced by conventional methods.

More particularly, the invention is aimed at providing a method of simultaneously realizing an r value of about 1.3 or greater, a ridging height of about 20 μm or less and an intra-face anisotropy (Δr) of about 0.25 or less in terms of absolute value, without posing strict restriction on the ferritic stainless steel composition, i.e., for a wide variety of ferritic stainless steel compositions.

Another object of the invention is to provide a method of producing a ferritic stainless steel strip that eliminates problems such as degradation in the surface nature of the product strip, failure to catch the material in the roll nip and inferior profiling of the product strip.

We have now discovered that controlling the coefficient of friction between the roll and the rolled ferritic stainless steel material during rough hot rolling is an important factor for overcoming the mentioned problems. We have discovered that remarkable improvement in both r value and anti-ridging characteristics in addition to remarkable improvement in intra-face anisotropy can be achieved, and that none of the aforesaid problems plaguing known methods, when hot rolling of a ferritic stainless steel material (particularly rough rolling and, as required, finish rolling) was controlled in accordance with this invention, as will be further described.

The invention provides a method of producing a ferritic stainless steel strip having reduced intra-face anisotropy, comprising subjecting a ferritic stainless steel slab to a hot rolling step including rough rolling having at least one rough rolling pass and finish rolling having at least one finish rolling pass, followed by the steps of hot-rolled sheet annealing, pickling, cold rolling and finish annealing, with at least one of the passes in the rough rolling conducted under a rolling temperature between about 970° to 1150° C., a friction coefficient between the rolls and the rolled material of about 0.3 or less and a rolling reduction ratio between about 40 to 75%.

At least one of the passes in the finish rolling procedure may be conducted with the rolling temperature between about 600° to 950° C. and the rolling reduction ratio between about 20 to 45%.

At least one of the finish rolling passes may be conducted with a friction coefficient between the rolled material and the rolls of about 0.3 or less.

The method of the invention also may be carried out such that at least one of the passes in the finish rolling is conducted with the rolling temperature between about 600° to 950° C., the rolling reduction ratio between about 20 to 45% and the friction coefficient between the rolled material and the rolls being about 0.3 or less.

The term "pass" is used here to mean rolling effected by one of roll stands in a rolling mill.

According to the invention a superior r value and anti-ridging characteristics, as well as reduced intraface anisotropy, can be achieved relative to known methods for a wide variety of ferritic stainless steel compositions. The advantages of the invention, however, are particularly remarkable when the elemental quantities of the ferritic stainless steel composition fall within the following ranges:

C: not more than about 0.1 wt %, preferably about 0.0010 to 0.080 wt %

Si: not more than about 1.5 wt %, preferably about 0.10 to 0.80 wt %

Mn: not more than about 1.5 wt %, preferably about 0.10 to 1.50 wt %

Cr: about 11 to 20 wt %, preferably about 14 to 19 wt %

Ni: not more than about 2.0 wt %, preferably about 0.01 to 1.0 wt %

P: not more than about 0.08 wt %, preferably about 0.010 to 0.080 wt %

S: not more than about 0.010 wt %, preferably about 0.0010 to 0.0080 wt %

N: not more than about 0.1 wt %, preferably about 0.002 to 0.08 wt %

The ferritic stainless steel composition may further contain one, two or more selected from the group consisting of:

Nb: about 0.050 to 0.30 wt %, Ti: about 0.050 to 0.30 wt %,

Ai: about 0.010 to 0.20 wt %, V: about 0.050 to 0.30 wt %,

Zr: about 0.050 to 0.30 wt %, Mo: about 0.50 to 2.5 wt %, and Cu: about 0.50 to 2.5 wt %.

The balance of the composition is substantially Fe and incidental impurities.

The invention will be further detailed in the following description.

The essence or the critical feature of the method of the invention for producing a ferritic stainless steel strip which excels in three factors: namely, r value, anti-ridging characteristics and intra-face anisotropy, is that at least one pass during rough rolling in hot rolling is conducted to simultaneously satisfy the following three conditions: (1) rolling temperature ranging from about 970° to 1150° C., (2) rolling reduction ratio ranging from about 40 to 75%, and (3) friction coefficient being not greater than 0.30.

A technique for hot rolling a ferritic stainless steel under lubrication is disclosed in Japanese Patent Laid-Open No. 4-27902. This method, however, seeks to suppress generation surface flaws in the rolled product and is not intended to improve the above-mentioned three factors (r value, anti-ridging characteristics and intraface anisotropy). Careful examination of the disclosure, particularly the examples, reveals that the examples are of laboratory-scale and rough rolling seems to be effected by the initial three to four passes, the maximum reduction ratio being 37% in each pass. In addition, this published specification completely fails to consider the friction between the roll and the rolled material.

The report "Optimum Setting Control Method in Hot-Strip Finish Rolling (2)" (1984 Spring Session of Plastic Works, May, 1984, pp, 29–32, particularly p. 30) recites measurements of friction coefficient in finish rolling (not rough rolling) of hot rolling processes for 18% Cr stainless steel under lubrication. The report reveals that the friction coefficient fluctuates over a range between 0.397 and 0.147. This report contains no suggestion whatsoever that the friction coefficient should be adjusted to be 0.3 or less in at least one pass in the rough rolling.

In general, rolling temperature in rough rolling of ferrite stainless steel ranges from about 1000° to 1300° C.

The invention is clearly distinguished from these known methods in that the three factors of r value, anti-ridging characteristics and intra-face anisotropy are improved by controlling rough rolling conditions, in particular the rolling temperature, rolling reduction ratio and the friction coefficient, to meet the specified predetermined ranges set forth herein. The objects of the invention are achieved when the above-mentioned conditions are simultaneously met in at least one pass in the rough rolling.

BRIEF DESCRIPTION OF THE DRAWING

The Figure is a graph showing effects of the rough rolling final pass draft, the friction coefficient in the rough rolling final pass, and the maximum draft per finish rolling pass on intra-face anisotropy ($\Delta r$).

DESCRIPTION OF THE PREFERRED EMBODIMENTS

A detailed description will now be given of an experiment which illustrates one example of a method in accordance with the present invention. It is not intended to define or to limit the scope of the invention, which is defined in the appended claims.

The experiment was conducted by using a commercially available ferritic stainless steel (C: 0.058%, Si: 0.32 wt %, Mn: 0.52 wt %, Cr: 16.5 wt %, Ni: 0.09 wt %, P: 0.027 wt %, S: 0.0038 wt %, N: 0.0317 wt %). The slab was heated to 1150° C. and was subjected to hot rolling which included four rough rolling passes and 5 to 7 finish rolling passes, whereby a hot-rolled steel sheet of 4.0 mm thick was obtained. The hot rolling was conducted under various conditions. More specifically, the final pass (rolling temperature: 1020° to 1080° C.) of the rough rolling was conducted while varying the reduction ratio and the friction coefficient (μ) between the roll and the rolled material, while, in the finish rolling (rolling temperature: 830° to 860° C., friction coefficient: 0.1) the maximum reduction ratio per pass was varied.

Samples of the resulting hot-rolled steel sheets were subjected to a series of treatments including hot-rolled sheet annealing, pickling, cold rolling and finish annealing to obtain cold rolled and annealed steel sheets 0.7 mm thick. Test pieces from these cold rolled and annealed steel sheets were subjected to measurements necessary to obtain the intra-face anisotropy (Δr) of the r value. The anisotropy Δr was calculated according to the equation $\Delta r=(r_L-2r_D+r_c)/2$, where $r_L$, $r_D$ and $r_c$ respectively show Lankford values r as measured in the rolling direction, a direction 45° to the rolling direction and a direction 90° to the rolling direction.

The effect of the rolling conditions on the anisotropy Δr is shown in the drawing.

The drawing reveals that Δr does not appreciably improve despite an increase in the reduction ratio when the final pass of the rough rolling is conducted without lubrication ($\mu \simeq 0.6$), yet is remarkably improved by controlling the reduction ratio to be 40% or greater when the friction coefficient μ is 0.1.

It is also seen in the drawing that a further improvement in the anisotropy Δr is attained by increasing the maximum reduction ratio per pass in the finish rolling when the friction coefficient μ and the rolling reduction in the final pass in the rough rolling are respectively $\mu=0.1$ and 40% or greater.

Even greater improvement in the anisotropy Δr is observed when the reduction ratio of the final pass in the rough rolling is 45% or greater.

Having considered one illustrative example in accordance with the invention, we turn now to a consideration of the process conditions in accordance with this invention.

According to this invention, at least one pass in the rough rolling of hot rolling is conducted so as to simultaneously meet all of the following three conditions (1), (2) and (3):

(1) Rolling temperature: from about 970° to 1150° C.

When the rolling temperature in the rough rolling is below about 970° C., recrystallization of the ferritic stainless steel does not proceed, resulting in impaired workability and no improvement in intra-face anisotropy. In addition, the roll cannot withstand extended use under large reduction ratios. Conversely, when the rolling temperature exceeds about 1150° C., the ferrite grains elongate in the rolling direction, thus increasing intraface anisotropy. It is therefore necessary that the rolling temperature in the rough rolling ranges from about 970° to 1150° C., preferably from about 1000° to 1100° C.

(2) Reduction ratio: from about 40 to 75%

When the reduction ratio in the rough rolling is below about 40%, a large volume of un-recrystallized structure remains in the core portion of the steel sheet. Consequently, workability is impaired and no improvement in intra-face anisotropy is obtained. Reduction ratio exceeding 75%, however, increases the probability of failure to catch the sheet in the roll nips, seizure between the steel sheet and a roll, and sheet thickness variation due to impact generated when catching the sheet in the roll nip. It is therefore necessary that the reduction ratio in the rough rolling ranges from about 40 to 75%, preferably from about 45 to 60%.

(3) Friction coefficient: about 0.30 or less

When the friction coefficient in the rough rolling exceeds about 0.30, un-recrystallized structure remains in the core of the sheet, although recrystallization occurs in the surface regions which receive heavy shearing strain. Consequently, workability is impaired and no improvement in intra-face anisotropy is obtained. Furthermore, the surface nature of the rolled steel sheet is deteriorated due to seizure between a roll and the rolled steel sheet. Conversely, when the friction coefficient in the rough rolling is about 0.3 or smaller, static recrystallization is remarkably promoted in the core region of the sheet, markedly improving the r value, anti-ridging characteristics and intra-face anisotropy. It is therefore necessary that the friction coefficient in the rough rolling be about 0.30 or less, preferably about 0.20 or less. No specific lower limit is posed on the range of the coefficient of friction, provided that the steel sheet can safely and smoothly be introduced into the roll nip. Any lubrication method known to those skilled in the art may be employed for the purpose of reducing the friction coefficient.

Simultaneous improvement in the three factors, namely, r value, anti-ridging characteristic and intraface anisotropy, can be achieved only when at least one rough rolling pass is conducted so as to simultaneously meet the above-mentioned three conditions. For example, intra-face anisotropy cannot be reduced to a satisfactory level when condition (3) is not met, even if the other two conditions (1) and (2) are satisfied.

The above-mentioned "at least one rough rolling pass" may be any one of the passes in the rough rolling step. In practice, the above-mentioned three conditions are met when a rolling by a stand satisfying the condition (1) is executed in such a manner as to satisfy the conditions (2) and (3).

Finish Rolling Step:

A further improvement in intra-face anisotropy is attainable by conducting, subsequent to the above-described rough rolling step, a finish rolling step which includes at least one pass meeting the following conditions (4), (5) and (6). Improvement is observed even by only satisfying the required friction coefficient.

(4) Rolling temperature: from about 600° to 950° C.

It is difficult to obtain a reduction ratio of 20% or greater when the rolling temperature is below about 600° C. Such a low rolling temperature also causes heavy wear of the rolls. Conversely, when the rolling temperature exceeds about 950° C., little improvement in intra-face anisotropy occurs due to limited accumulation of rolling strain. Therefore, the rolling temperature should range from about 600° to 950° C., preferably from about 750° to 900° C.

(5) Reduction ratio: from about 20 to 45%

Little improvement in intra-face anisotropy is obtained when the reduction ratio is below about 20%, while a reduction ratio exceeding about 45% impairs the nature of the steel sheet surface. Therefore, the reduction ratio should range from about 20 to 45%, preferably from about 25 to 35%.

Significant improvement in intra-face anisotropy can be obtained in any pass in which this reduction ratio is employed, provided that the condition (4) concerning the rolling temperature is met.

(6) Friction coefficient: about 0.3 or less

When the friction coefficient is about 0.3 or less, improvement in all the three factors, i.e., the r value, anti-ridging characteristics and intra-face anisotropy, can be achieved simultaneously through a promotion of static recrystallization at the sheet core or through an increase in strain accumulation. The low friction coefficient also suppresses sheet thickness variation and prevents seizure between the roll and the steel sheet.

The method of the invention can be carried out in accordance with ordinary production conditions, provided that the conditions specifically mentioned above are satisfied. For instance, the slab heating temperature preferably ranges from about 1050° to 1300° C., rough rolling temperature preferably ranges from about 900° to 1300° C., the finish rolling temperature preferably ranges from about 550° to 1050° C., the hot-rolled sheet annealing temperature preferably ranges from about 650° to 1100° C., and the cold-rolled sheet annealing temperature preferably ranges from about 750° to 1100° C. The type of the lubricant, as well as the lubricating method, also may be determined in accordance with known methods.

The invention can be applied to any ferritic stainless steel irrespective of the composition. However, the invention is particularly advantageous when the ferritic steel composition contains: C: not more than about 0.1 wt %, Si: not more than about 1.5 wt %, Mn: not more than about 1.5 wt %, Cr: about 11 to 20 wt %, Ni: not more than about 2.0 wt %, P: not more than about 0.08 wt %, S: not more than about 0.010 wt %, N: not more than about 0.1 wt %, and, as necessary, one, two or more selected from the group consisting of: Nb: about 0.050 to 0.30 wt %, Ti: about 0.050 to 0.30 wt %, Ai: about 0.010 to 0.20 wt %, V: about 0.050 to 0.30 wt %, Zr: about 0.050 to 0.30 wt %, Mo: about 0.50 to 2.5 wt %, and Cu: about 10 0.50 to 2.5 wt %, and the balance being substantially Fe and incidental impurities.

In particular, from the view point of improving anti-ridging characteristics and intra-face anisotropy, the invention can be advantageously applied to a ferritic stainless steel having a composition containing: C: about 0.0010 to 0.080 wt %, Si: about 0.10 to 0.80 wt %. Mn: about 0.10 to 1.50 wt %, Cr: about 14 to 19 wt %, Ni: about 0.01 to 1.0 wt %, P: about 0.010 to 0.080 wt %, S: about 0.0010 to 0.0080 wt %, N: about 0.002 to 0.08 wt %, and, as necessary, one, two or more selected from the group consisting of: Nb: about 0.050 to 0.30 wt %, Ti: about 0.050 to 0.30 wt %, Ai: about 0.010 to 0.20 wt %, V: about 0.050 to 0.30 wt %, Zr: about 0.050 to 0.30 wt %, Mo: about 0.50 to 2.5 wt %, and Cu: about 0.50 to 2.5 wt %, and the balance substantially Fe and incidental impurities.

Any composition having element contents falling within these ranges exhibits a two-phase structure of $\alpha+\gamma$ at high temperature region (800° to 1300° C.). This structure, when subjected to rough rolling, exhibits enhanced partial transformation from s-phase to y-phase so as to strongly divide the ferrite band of {100} azimuth at the core portion during lubricated rolling at large reduction ratio, thus accelerating the improvement in the anti-ridging characteristics and intra-face anisotropy.

The invention will now be described through illustrative examples which are not intended to limit the scope of the invention defined in the appended claims.

EXAMPLE 1

Steel samples A to L having chemical compositions as shown in Table 1 were molten and formed into slabs. Each of the slabs was heated to 1200° C. and then subjected to a hot rolling mill having four rough rolling stands and seven finish rolling stands, to form hot-rolled sheet 4.0 mm thick. Each hot-rolled sheet was subjected to an ordinary processing including a hot-rolled sheet annealing (850° C.×4 hr), pickling, cold rolling (reduction ratio 82.5%), and finish annealing (860° C.× 60 seconds), to form a cold rolled and annealed sheet 0.7 mm thick. The hot rolling was conducted while varying the reduction ratio and the friction coefficient of the third or fourth rough rolling stand. Reduction ratios of other stands in the rough rolling process were smaller than that of the third or the fourth stands. The finish rolling step was conducted such that the maximum reduction ratio per pass was not greater than 18%. In the rolling of each of the samples A1j, D1j and E3j, lubrication was conducted in the seventh stand of the finish rolling mill so as to reduce the friction coefficient to 0.1, while other samples were rolled without lubrication.

Adjustment of friction coefficient of the third or fourth rough rolling stand was conducted by changing the ratio of mixing of the lubricant with water. A lubricant produced by Hanano Shoji of the trade name T2 (mineral oil containing low-melting point glassy material: $P_2O_5$, $B_2O_3$ and $Na_2O$) was used. The friction coefficient was measured in accordance with a known method based on Orowans's mix friction rolling theory.

TABLE 1

| | CHEMICAL COMPOSITION (wt %) | | | | | | | | | | | | | |
|---|---|---|---|---|---|---|---|---|---|---|---|---|---|---|
| Steel | C | Si | Mn | P | S | Cr | Ni | Al | N | Nb | Ti | Mo | B | Remarks |
| A | 0.011 | 0.49 | 0.51 | 0.024 | 0.0041 | 11.2 | 0.01 | 0.033 | 0.0076 | — | 0.16 | — | — | |
| B | 0.0074 | 1.38 | 0.58 | 0.025 | 0.0048 | 11.4 | 0.11 | 0.008 | 0.0081 | — | 0.18 | — | — | |
| C | 0.059 | 0.41 | 0.62 | 0.031 | 0.0050 | 16.2 | 0.09 | 0.082 | 0.0135 | — | — | — | — | * |
| D | 0.061 | 0.31 | 0.64 | 0.030 | 0.0049 | 16.3 | 0.29 | 0.014 | 0.0452 | — | — | — | — | * |
| E | 0.061 | 0.32 | 0.59 | 0.033 | 0.0045 | 16.2 | 0.10 | 0.001 | 0.0348 | — | — | — | — | * |
| F | 0.0021 | 0.29 | 0.52 | 0.026 | 0.0018 | 16.5 | 0.10 | 0.001 | 0.0213 | 0.18 | — | — | — | * |
| G | 0.0020 | 0.31 | 0.51 | 0.025 | 0.0021 | 16.4 | 0.11 | 0.11 | 0.0221 | 0.15 | — | — | — | * |
| H | 0.0022 | 0.32 | 0.50 | 0.025 | 0.0020 | 16.5 | 0.11 | 0.12 | 0.0198 | 0.15 | — | 1.5 | 0.0011 | * |
| I | 0.0019 | 0.31 | 0.48 | 0.024 | 0.0015 | 16.4 | 0.09 | 0.001 | 0.0201 | — | 0.11 | — | — | * |
| J | 0.0020 | 0.30 | 0.47 | 0.021 | 0.0022 | 16.2 | 0.10 | 0.002 | 0.0030 | 0.09 | — | — | — | |
| K | 0.0082 | 0.06 | 0.15 | 0.025 | 0.0042 | 17.8 | 0.08 | 0.024 | 0.0161 | — | 0.26 | 1.2 | — | |
| L | 0.0043 | 0.30 | 0.16 | 0.027 | 0.0012 | 19.1 | 0.21 | 0.011 | 0.0052 | 0.34 | — | 1.9 | — | |
| M | 0.052 | 0.25 | 0.15 | 0.031 | 0.0061 | 16.5 | 0.11 | 0.021 | 0.0011 | — | — | — | — | |
| N | 0.020 | 0.17 | 0.30 | 0.027 | 0.0065 | 16.5 | 0.09 | 0.013 | 0.0095 | — | 0.80 | — | — | |

*STEEL having ($\alpha + \gamma$) two - phase structure at high temperature region.

Test pieces obtained from the steel sheets were subjected to measurements of the r value, Δr and ridging which were conducted as follows:

deterioration of the surface nature, no failure to introduce the sheet into the roll nip and no inferior profiling.

TABLE 2

| Steel | Rough-Rolling Max Draft (%) | Friction Coefficient | Rolling Temperature (°C.) | Δ r | r | Ridging Height (μm) | Remarks |
|---|---|---|---|---|---|---|---|
| A 1 | 42 | 0.2 | 1071 | 0.11 | 1.81 | 10 | Invention |
| 2 | 47 | 0.2 | 1045 | 0.09 | 1.87 | 8 | Invention |
| 3 | 45 | *No Lubrication | 1051 | 0.34 | 1.36 | 26 | Comparative Ex. |
| B 1 | 45 | 0.1 | 1063 | 0.12 | 1.74 | 12 | Invention |
| 2 | *32 | 0.1 | 1050 | 0.37 | 1.18 | 27 | Comparative Ex. |
| 3 | 45 | 0.2 | *1170 | 0.35 | 1.21 | 27 | Comparative Ex. |
| C 1 | 46 | 0.2 | 1053 | 0.08 | 1.51 | 14 | Invention |
| 2 | 62 | 0.1 | 1045 | 0.10 | 1.59 | 13 | Invention |
| 3 | *30 | *0.4 | 1073 | 0.39 | 1.10 | 38 | Comparative Ex. |
| D 1 | 41 | 0.2 | 1017 | 0.08 | 1.41 | 8 | Invention |
| 2 | 46 | 0.2 | 1046 | 0.07 | 1.42 | 8 | Invention |
| 3 | 58 | 0.1 | 1052 | 0.07 | 1.48 | 6 | Invention |
| 4 | 42 | *No lubrication | 1076 | 0.36 | 1.08 | 31 | Comparative Ex. |
| E 1 | 43 | 0.2 | 1051 | 0.09 | 1.36 | 8 | Invention |
| 2 | 47 | 0.1 | 1055 | 0.09 | 1.37 | 7 | Invention |
| 3 | 62 | 0.1 | 1052 | 0.08 | 1.40 | 7 | Invention |
| 4 | *35 | *No lubrication | 1087 | 0.35 | 0.98 | 33 | Comparative Ex. |
| F 1 | 42 | 0.2 | 1071 | 0.05 | 1.86 | 9 | Invention |
| 2 | 51 | 0.2 | 1050 | 0.05 | 1.95 | 7 | Invention |
| 3 | *35 | 0.1 | 1038 | 0.33 | 1.35 | 29 | Comparative Ex. |
| G 1 | 40 | 0.1 | 1057 | 0.07 | 1.91 | 10 | Invention |
| 2 | 43 | 0.1 | 1062 | 0.06 | 1.90 | 8 | Invention |
| 3 | 61 | 0.1 | 1049 | 0.04 | 1.99 | 8 | Invention |
| H 1 | 41 | 0.2 | 1046 | 0.09 | 1.76 | 13 | Invention |
| 2 | 46 | 0.2 | 1055 | 0.08 | 1.78 | 12 | Invention |
| 3 | 42 | *No Lubrication | 1055 | 0.31 | 1.29 | 31 | Comparative Ex. |
| I 1 | 43 | 0.1 | 1051 | 0.11 | 1.79 | 7 | Invention |
| 2 | 48 | 0.1 | 1054 | 0.10 | 1.81 | 7 | Invention |
| J 1 | 42 | 0.2 | 1034 | 0.13 | 1.83 | 18 | Invention |
| 2 | 61 | 0.2 | 1060 | 0.13 | 1.85 | 16 | Invention |
| K 1 | 42 | 0.1 | 1041 | 0.12 | 1.77 | 10 | Invention |
| 2 | 61 | 0.2 | 1050 | 0.11 | 1.78 | 9 | Invention |
| L 1 | 43 | 0.2 | 1068 | 0.11 | 1.68 | 18 | Invention |
| 2 | 60 | 0.1 | 1047 | 0.09 | 1.69 | 17 | Invention |
| A1j | 42 | 0.2 | 1070 | 0.09 | 1.89 | 8 | Invention |
| D1j | 41 | 0.2 | 1017 | 0.06 | 1.50 | 6 | Invention |
| E3j | 62 | 0.1 | 1052 | 0.07 | 1.50 | 5 | Invention |

Measurement of r value:

Test pieces prepared in accordance with JIS (Japanese Industrial Standards) 13B were tensed to sustain 15% strain and r values were measured on three points on the strained test pieces. The mean value of the measured r values was calculated and taken as the r value.

Measurement of Δr:

Intra-face anisotropy Δr was determined from the r values measured as described above, in accordance with the equation of $\Delta r=(r_L-2r_D+r_c)/2$, where $r_L$, $r_D$ and $r_c$ respectively show Lankford values r as measured in the rolling direction, a direction 45° to the rolling direction and a direction 90° to the rolling direction.

Measurement of ridging:

Test pieces according to JIS 5 were extracted from the samples such that the longitudinal axis of the test piece coincided with the rolling direction. Each test piece was strained to sustain 20% strain and the height of ridging was measured by a surface coarseness meter.

The maximum reduction ratios, friction coefficients and rolling temperatures in the rough rolling process, as well as the rolling results, are shown in Table 2. All steel strips produced in accordance with the invention exhibited no From Table 2, it is seen that the steel sheets produced in accordance with the invention exhibit superior r values and anti-ridging characteristics. It is also seen that a small intra-face anisotropy Δr of 0.13 or less can be obtained by a single cold rolling.

EXAMPLE 2

Steel samples A to L having chemical compositions as shown in Table 1 were molten and formed into slabs. Each of the slabs was heated to 1200° C. and then subjected to a hot rolling mill having four rough rolling stands and seven finish rolling stands, to form hot-rolled sheet 4.0 mm thick. Each hot-rolled sheet was subjected to an ordinary processing including a hot-rolled sheet annealing (850° C.×4 hr), pickling, cold rolling (reduction ratio 82.5%), and finish annealing (860° C.× 60 seconds), to form a cold rolled and annealed sheet 0.7 mm thick.

The rolling was conducted while varying the reduction ratio and the friction coefficient in the third or fourth rough rolling stand, as well as the reduction ratio of the sixth or seventh finish rolling stand. The reduction ratios of other rough rolling stands were smaller than those of the third or the fourth rough rolling stands. Similarly, reduction ratios of other finish rolling stands were smaller than those of the sixth and seventh finish rolling stands.

The adjustment of the friction coefficient in the rough rolling step was conducted in the same way as Example 1. Adjustment of the friction coefficient in the finish rolling step was conducted by changing the ratio of mixing of the lubricant with water. A lubricant produced by Nippon Quaker by the trade name HB-20KC (mineral oil containing synthetic ester)). The friction coefficients were measured in the same manner as in Example 1.

Test pieces obtained from the steel sheets were subjected to measurements of the r value, dr and ridging which were conducted in accordance with the same methods as those in Example 1.

The reduction ratios, friction coefficients and the rolling temperatures in the rough rolling process and the reduction ratios and rolling temperatures in the finish rolling process, as well as the rolling results, are shown in Table 3. All steel strips produced in accordance with the present invention exhibited no deterioration of the surface nature, no failure to introduce the sheet into the roll nip and no inferior profiling.

TABLE 3

| | | Rough Rolling | | | Finishing Rolling | | | | | Ridging | |
|---|---|---|---|---|---|---|---|---|---|---|---|
| Steel | | Max. Draft (%) | Friction Coefficient | Temperature (°C.) | Draft (%) | Friction Coefficient | Temperature (°C.) | Δr | r | Height (μm) | Remarks |
| A | 4 | 42 | 0.2 | 1061 | 25 | 0.2 | 850 | 0.06 | 1.96 | 7 | Invention |
| | 5 | 47 | 0.1 | 1043 | 27 | 0.2 | 853 | 0.03 | 2.01 | 5 | Invention |
| | 6 | 45 | *No lubricant | 1050 | 21 | 0.2 | 852 | 0.30 | 1.38 | 21 | Comparative Ex. |
| B | 4 | 45 | 0.1 | 1063 | 23 | 0.2 | 793 | 0.07 | 1.81 | 8 | Invention |
| | 5 | *32 | 0.1 | 1050 | 25 | 0.2 | 815 | 0.32 | 1.20 | 23 | Comparative Ex. |
| | 6 | 45 | 0.2 | *1170 | 25 | 0.2 | 820 | 0.19 | 1.23 | 22 | Comparative Ex. |
| C | 4 | 46 | 0.2 | 1053 | 21 | 0.25 | 645 | 0.03 | 1.70 | 8 | Invention |
| | 5 | 62 | 0.1 | 1045 | 38 | 0.25 | 871 | 0.03 | 1.79 | 8 | Invention |
| D | 5 | 41 | 0.2 | 1017 | 24 | 0.1 | 891 | 0.04 | 1.64 | 4 | Invention |
| | 6 | 46 | 0.2 | 1046 | 25 | 0.1 | 854 | 0.04 | 1.65 | 4 | Invention |
| | 7 | 58 | 0.1 | 1052 | 35 | 0.1 | 720 | 0.02 | 1.69 | 3 | Invention |
| | 8 | 45 | 0.2 | 1051 | 25 | 0.2 | 851 | 0.05 | 1.60 | 5 | Invention |
| | 9 | 45 | 0.2 | 1049 | 25 | No lubricant | 850 | 0.06 | 1.51 | 7 | Invention |
| | 10 | 42 | *No lubricant | 1076 | 24 | 0.1 | 887 | 0.34 | 1.14 | 26 | Comparative Ex. |
| E | 5 | 43 | 0.2 | 1051 | 31 | 0.3 | 814 | 0.06 | 1.54 | 5 | Invention |
| | 6 | 47 | 0.1 | 1055 | 24 | 0.3 | 853 | 0.06 | 1.55 | 5 | Invention |
| | 7 | 62 | 0.1 | 1052 | 23 | 0.3 | 862 | 0.05 | 1.58 | 4 | Invention |
| F | 4 | 42 | 0.2 | 1071 | 21 | 0.1 | 890 | 0.03 | 1.97 | 6 | Invention |
| | 5 | 51 | 0.2 | 1050 | 21 | No lubricant | 861 | 0.02 | 2.11 | 4 | Invention |
| | 6 | 51 | 0.2 | 1050 | 39 | No lubricant | 864 | 0.01 | 2.23 | 3 | Invention |
| | 7 | *35 | 0.1 | 1038 | 25 | 0.1 | 850 | 0.19 | 1.39 | 24 | Comparative Ex. |
| G | 4 | 40 | 0.1 | 1057 | 25 | 0.2 | 848 | 0.02 | 2.07 | 5 | Invention |
| | 5 | 40 | 0.1 | 1062 | 25 | 0.2 | 692 | 0.02 | 2.30 | 5 | Invention |
| | 6 | 61 | 0.1 | 1049 | 38 | 0.2 | 850 | 0.01 | 2.24 | 3 | Invention |
| H | 4 | 46 | 0.2 | 1055 | 21 | 0.2 | 861 | 0.04 | 1.89 | 7 | Invention |
| | 5 | 46 | 0.2 | 1055 | 22 | 0.2 | 723 | 0.05 | 1.92 | 5 | Invention |
| I | 3 | 43 | 0.1 | 1051 | 30 | 0.2 | 851 | 0.07 | 1.91 | 3 | Invention |
| | 4 | 48 | 0.1 | 1054 | 30 | 0.2 | 852 | 0.04 | 1.97 | 3 | Invention |
| J | 3 | 42 | 0.2 | 1034 | 26 | 0.2 | 765 | 0.08 | 2.01 | 9 | Invention |
| K | 3 | 46 | 0.2 | 1050 | 23 | 0.2 | 810 | 0.07 | 1.82 | 6 | Invention |
| L | 3 | 60 | 0.1 | 1047 | 24 | 0.2 | 815 | 0.08 | 1.84 | 10 | Invention |

From Table 3, it is seen that the steel sheets produced in accordance with the invention exhibit superior r values and anti-ridging characteristics. It is also seen that an extremely small intra-face anisotropy Δr of 0.08 or less can be obtained. A comparison of the values obtained in Sample Nos. F2, F5 and F6 reveals that improvements in Δr, r value and anti-ridging characteristic can be enhanced by elevating the level of the maximum reduction ratio per pass in the 10 finish rolling step. By comparing the data obtained in Sample Nos. D6, D8 and D9, it is observed that the improvements are enhanced by reducing the friction coefficient.

EXAMPLE 3

Steel Samples M and N having chemical compositions as shown in Table 1 were molten and formed into slabs. Each of the slabs was heated to 1200° C. and then subjected to a hot rolling mill having four rough rolling stands and seven finish rolling stands, to form hot-rolled sheet 4.0 mm thick. Each hot-rolled sheet was subjected to an ordinary processing including a hot-rolled sheet annealing (850° C.×4 hr), pickling, cold rolling, and finish annealing (860° C.×60 seconds), to form a cold rolled and annealed sheet 0.7 mm thick.

The rolling was conducted while varying the reduction ratio and the friction coefficient in the fourth rough rolling stand. At the same time, the rolling rate in the seventh finish rolling stand was changed to vary the strain rate. The friction coefficient of the seventh stand in the finish rolling process was fixed at 0.2. The reduction ratios of other rough rolling stands were smaller than that of the fourth rough rolling stand. Similarly, reduction ratios of other finish rolling stands were smaller than that of the seventh finish rolling stand.

The adjustment of the friction coefficient in the rough rolling step was conducted in the same way as Example 1. The friction coefficients were measured in the same way as in Example 1.

Test pieces obtained from the steel sheets were subjected to measurements of the r value, Δr and ridging which were conducted in the same manner as in Example 1.

The reduction ratios, friction coefficients and rolling temperatures in the rough rolling and the reduction ratios, strain rate and rolling temperatures in the finish rolling, as well as the rolling results, are shown in Table 4. All steel strips produced in accordance with the present invention exhibited no deterioration of the surface nature, no failure to introduce the sheet into the roll nip and no inferior profiling.

TABLE 4

| | Rough Rolling | | | Finishing Rolling | | | | Ridging | | | |
|---|---|---|---|---|---|---|---|---|---|---|---|
| | | | | | | Strain | | | | | |
| No. | Draft (%) | Friction Coefficient | Temperature (°C.) | Draft (%) | Friction Coefficient | Rate (l/s) | Temperature (°C.) | Δ r | r | Height (μm) | Remarks |
| M 1 | 45 | 0.1 | 1055 | 18 | 0.2 | 150 | 862 | 0.04 | 1.89 | 7 | Invention |
| 2 | *35 | *No lubricant | 1060 | 18 | 0.2 | 150 | 865 | 0.32 | 1.76 | 11 | Comparative Example |
| N 1 | 45 | 0.1 | 1061 | 18 | 0.2 | 165 | 864 | 0.05 | 1.95 | 8 | Invention |
| 2 | *35 | *No lubricant | 1057 | 18 | 0.2 | 165 | 863 | 0.27 | 1.81 | 14 | Comparative Example |

From Table 4, it is seen that steel sheets produced in accordance with the invention exhibit superior r values and anti-ridging characteristics. It is also seen that an extremely small intra-face anisotropy Δr of 0.04 or less can be obtained. In contrast, Comparison Samples Nos. M2 and N2 exhibit large intra-face anisotropy due to the small reduction ratio (35%).

The two Comparison Samples Nos. M2 and N2 satisfy the condition of (strain rate)/(friction coefficient)÷500 which is disclosed in the aforementioned Japanese Patent Laid-Open No. 62-10217. Nevertheless, these Comparison Samples exhibit large intra-face anisotropy. It is thus demonstrated that control of the ratio (strain rate)/(friction coefficient) alone does not improve intra-face anisotropy.

In accordance with the foregoing description of the invention, it is possible to produce a ferritic stainless steel sheet which exhibits reduced intra-face anisotropy and which excels both in r value and anti-ridging characteristics, without substantially restricting the composition of the ferritic stainless steel. In addition, the ferritic stainless steel strip possessing excellent properties described above can be produced without deterioration in the surface nature of the steel sheet, failure to introduce the sheet into the roll nip and inferior profiling of the steel sheet.

Although this invention has been described with reference to specific forms of apparatus and method steps, equivalent steps may be substituted, the sequence of the steps may be varied, and certain steps may be used independently of others. Further, various other control steps may be included, all without departing from the spirit and the scope of the invention defined in the appended claims.

What is claimed is:

1. A method of producing a ferritic stainless steel strip having reduced intra-face anisotropy, comprising:

(a) subjecting a ferritic stainless steel slab to a hot rolling having at least one rough rolling pass wherein at least one of the passes in said rough rolling is conducted with a rolling temperature between about 970° to about 1150° C., a friction coefficient between the rolls and the rolled material of about 0.3 or less and a rolling reduction ratio between about 40 to about 75%, and (b) providing finish rolling having at least one finish rolling pass, followed by hot-rolled sheet annealing, pickling, cold rolling and finish annealing.

2. A method according to claim 1, wherein at least one of the passes in said finish rolling is conducted with a rolling temperature between about 600° to about 950° C. and a rolling reduction ratio between about 20 to about 45%.

3. A method according to claim 1, wherein at least one of the passes in said finish rolling is conducted with a friction coefficient between the rolled material and the rolls of about 0.3 or less.

4. A method according to claim 1, wherein at least one of the passes in said finish rolling is conducted with a rolling temperature between about 600° to about 950° C., a rolling reduction ratio between about 20 to about 45% and a friction coefficient between the rolled material and the rolls of about 0.3 or less.

5. A method according to claim 1, wherein the friction coefficient between the rolls and the rolled material is about 0.2 or less.

* * * * *

UNITED STATES PATENT AND TRADEMARK OFFICE

CERTIFICATE OF CORRECTION

PATENT NO. : 5,505,797

DATED : April 9, 1996

INVENTOR(S) : Takeshi Yokota et al

It is certified that error appears in the above-indentified patent and that said Letters Patent is hereby corrected as shown below:

In Column 3, line 64, please change "Ai:" to --Al:--.

In Column 7, line 28, please change "Ai:" to --Al:--;

line 31, please delete "10"; and line 42, please change "Ai:" to --Al:--.

In Column 8, line 5, please change "s-phase to y-phase" to --α-phase to γ-phase--.

In Column 11, line 65, please delete "10".

Signed and Sealed this

Twenty-third Day of July, 1996

*Attest:*

Bruce Lehman

BRUCE LEHMAN

*Attesting Officer*

*Commissioner of Patents and Trademarks*